United States Patent [19]

Mosiewicz

[11] Patent Number: 4,930,989

[45] Date of Patent: Jun. 5, 1990

[54] FIXED-ANGLE KEYING PIECE FOR BLADES OF AXIAL FANS

[75] Inventor: Antonio Mosiewicz, Milan, Italy

[73] Assignee: Cofimco S.r.l., Italy

[21] Appl. No.: 184,054

[22] Filed: Apr. 20, 1988

[30] Foreign Application Priority Data

Apr. 24, 1987 [IT] Italy ..... 20279 A/87

[51] Int. Cl.[5] ..... F04D 29/34

[52] U.S. Cl. ..... 416/204 R; 416/209

[58] Field of Search ..... 416/204 RA, 209, 248

[56] References Cited

U.S. PATENT DOCUMENTS 1,453,873 5/1923 Hicks ..... 416/204 R
2,825,414 3/1958 Page ..... 416/204 R
3,323,711 6/1967 Myers ..... 416/204 R

FOREIGN PATENT DOCUMENTS 3017943 11/1980 Fed. Rep. of Germany ..... 416/204
20428 of 1890 United Kingdom ..... 416/204

*Primary Examiner*—Robert E. Garrett
*Assistant Examiner*—John T. Kwon

[57] ABSTRACT

The present invention relates to fixed-angle keying pieces for blades of axial fans each having a U-shaped cross section, the internal surface of which perfectly fits the profile of the blade while the external surface of the same has a plane side face which rests on a supporting plate, the keying piece being obtained as a continuous extruded section which is subsequently cut to a desired size.

1 Claim, 3 Drawing Sheets

FIXED-ANGLE KEYING PIECE FOR BLADES OF AXIAL FANS

SUMMARY OF THE INVENTION

This invention relates to a fixed-angle keying piece for blades of axial fans, which can be obtained very easily and cheaply as continuous extruded section which is subsequently cut down in desired sizes.

The keying pieces according to the present invention can be easily substituted in an axial fan with another similar keying piece having a different setting angle.

The angles of attack of the blades can therefore be changed by replacing the keying piece which, as said afore, can be made at a very cheap cost. The keying piece according to this invention has an U-shaped cross section, the internal surface of which perfectly fits the profile of the blade to be inserted thereinto. The external surface of the U shape has a plane side face which is rested onto the external face of the supporting plate assembled to the hub of the axial fan and has an angle of inclination to the axis of U shape such that the blade gets the desired setting angle.

DESCRIPTION OF THE PREFERRED EMBODIMENTS

Figure 1:
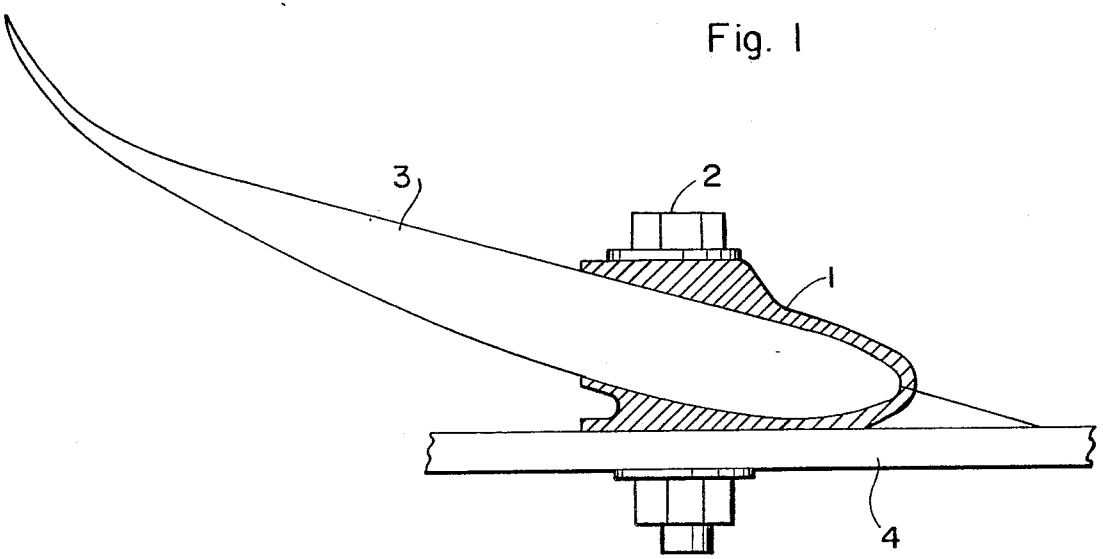
FIG. 1 is a cross-sectional view of an embodiment of the invention.

The rounded bottom end of the U shape has a thickness that allows a slight bending thereof in order to make the insertion of the blade into the keying piece as well as the fastening of the blade easier, the fastening being obtained by clamping the sides of the keying piece tightly against the profile of the blade by means of bolts through holes made on assembling, said bolts also fastening the keying pieces to the supporting plate. In the FIG. 1, a keying piece (1) completely assembled is shown (hatched cross section). The figure also shows a through bolt (2) for fastening the blade (3) within the keying piece according to the present invention and for fastening the keying piece onto the supporting plate (4). Obviously, the clamping bolts are at least two each keying piece, radially aligned (see FIG. 2).

Figure 2:
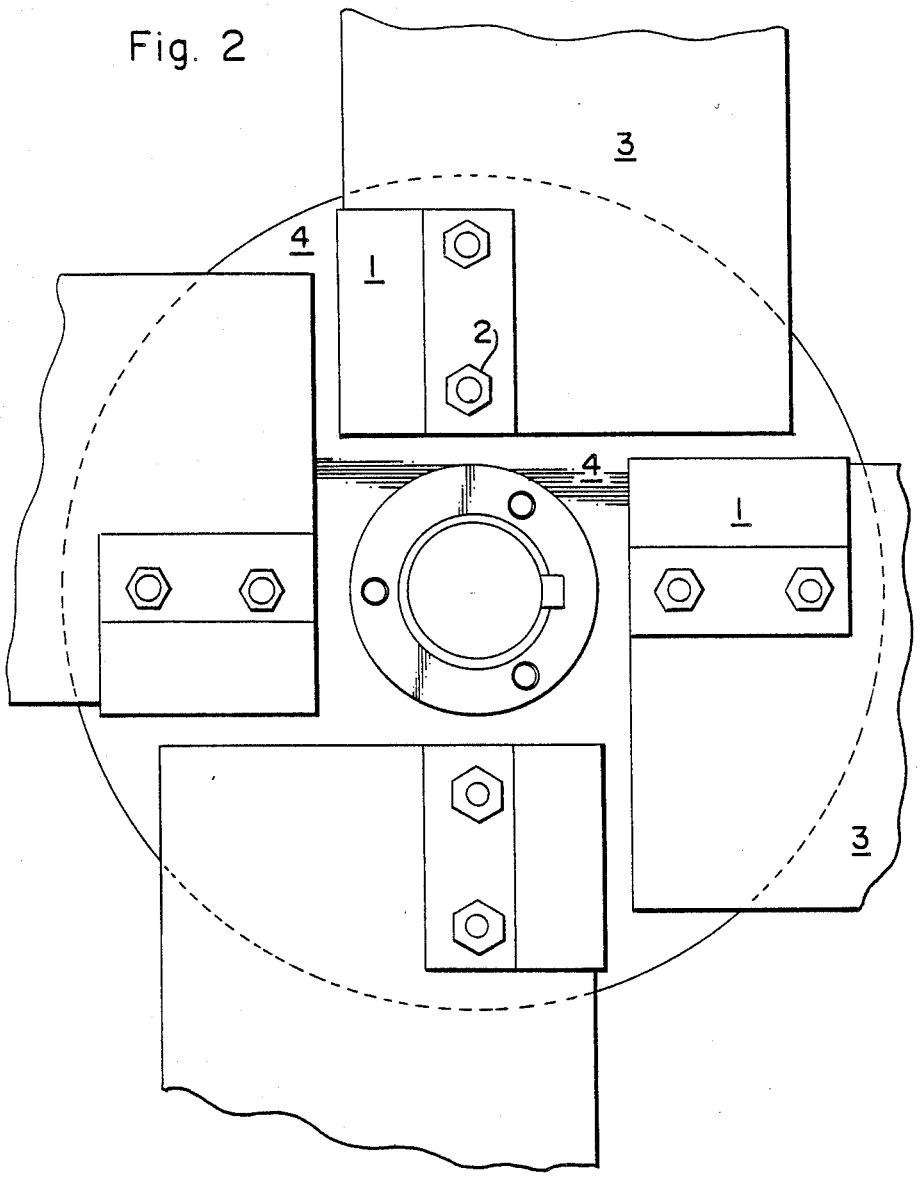
FIG. 2 is an overhead view of the embodiment shown in FIG. 1.
Figure 3:
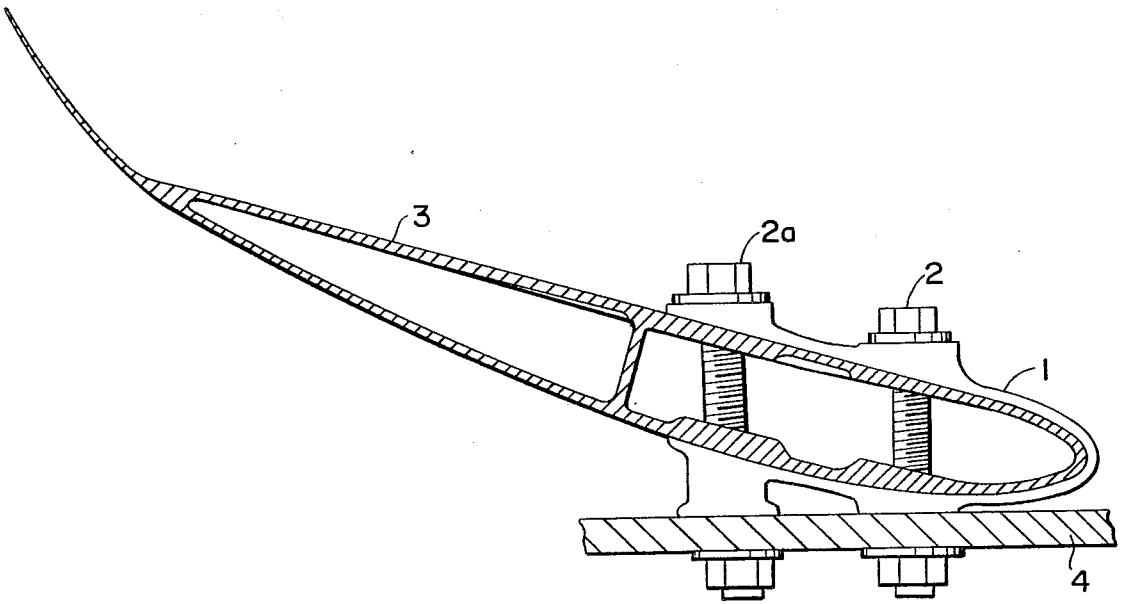
FIG. 3 is a cross-sectional view of another embodiment of the invention.

In the FIG. 2, the keying piece with inserted blade, assembled to the supporting plate, is shown as viewed from above. In the FIG. 3 a keying piece having a double supporting base with clamping bolts 2, 2*a* side by side, is shown. The keying piece according to the present invention can be made of a metal moldable with an extruder, such as aluminum and its alloys.

The device according to the present invention assures an identical setting angle to each blade: it is also very easy to be assembled.

As said above, the keying piece according to the present invention has a very low manufacturing cost per piece, chiefly in case of manufacture on a large scale, because it can be manufactured as continuous extrusion.

I claim:

1. A fixed-angle keying piece for blades of axial fans, comprising a U-shaped cross section; an internal surface which perfectly fits the profile of the blade and an external surface which contacts an external face of a supporting plate assembled to a hub of the axial fan; first and second rigid sidewalls which are approximately the same length; a rounded bottom end connecting said sidewalls, said bottom end having a thickness which allows a slight bending thereof for inserting the blade into the keying piece;

wherein each blade is fastened to said supporting plate via one of the keying pieces by clamping the sidewalls of the keying piece tightly against an outer profile of the blade by means of at least one through bolt which passes through at least one hole formed in the keying piece, blade, and supporting plate, and wherein said keying piece is extruded as a continuous extruded article and then cut down into single keying pieces.

* * * * *